US005354056A

United States Patent [19]

Cornish, III

[11] Patent Number: 5,354,056

[45] Date of Patent: Oct. 11, 1994

[54] GOLF CLUB AND METHOD

[75] Inventor: Joseph J. Cornish, III, Marietta, Ga.

[73] Assignee: Bradley K. Stone, Roswell, Ga.

[21] Appl. No.: 32,376

[22] Filed: Mar. 18, 1993

[51] Int. Cl.[5] ..... A63B 53/04; A63B 53/10

[52] U.S. Cl. ..... 273/81.6; 273/80 R; 273/80 B; 273/167 E; 273/DIG. 6; 273/168

[58] Field of Search ..... 273/167 R–177 A, 273/80 R, 81 B, 81.6, 81.5, 80 B, 80.6, 80.9, DIG. 6; D21/214, 221

[56] References Cited

U.S. PATENT DOCUMENTS

| | | | |
|---|---|---|---|
| D. 183,180 | 7/1958 | Phillips . | |
| D. 185,717 | 7/1959 | Newton . | |
| D. 231,624 | 5/1974 | Wilmoth . | |
| D. 268,357 | 3/1983 | Mader | D21/214 |
| D. 277,221 | 1/1985 | Kobayashi | D21/214 |
| D. 298,767 | 11/1988 | Szczepanski | D21/219 |
| D. 307,783 | 5/1990 | Iinuma | D21/214 |
| D. 316,583 | 4/1991 | Mahaffey et al. | D21/214 |
| 1,317,146 | 9/1919 | Welles | 273/80 B |
| 1,418,038 | 5/1922 | Tousey | 273/80 R |
| 1,431,313 | 10/1922 | Lawton . | |
| 1,526,438 | 2/1925 | Scott . | |
| 1,587,758 | 6/1926 | Charavay | 273/167 E |
| 1,662,712 | 3/1928 | Mensing . | |
| 1,781,290 | 11/1930 | Margrave | 273/81.5 |
| 1,974,389 | 9/1934 | Cowdery | 273/80 |
| 2,020,679 | 11/1935 | Fitzpatrick | 273/80 B |
| 2,023,885 | 12/1935 | Hinckley | 273/168 X |
| 2,083,189 | 6/1937 | Crooker | 273/167 E |
| 2,573,361 | 10/1951 | Rodgers, Jr. et al. | 64/2 |
| 2,822,175 | 4/1958 | Redmond | 273/80 B X |
| 2,912,245 | 11/1959 | Gardner | 273/DIG. 6 |
| 3,416,798 | 12/1968 | Pennington | 273/80 |
| 3,458,611 | 7/1958 | Roberts | 264/93 |
| 3,469,338 | 9/1969 | Hills | 43/18 |
| 3,625,518 | 12/1971 | Solheim | 273/175 |
| 4,498,673 | 2/1985 | Swanson | 273/172 |
| 4,648,598 | 3/1987 | Kim | 273/80 |
| 4,757,997 | 7/1988 | Roy | 273/80 |
| 5,042,805 | 8/1991 | Nakai | 273/80 |
| 5,092,599 | 3/1992 | Okumoto et al. | 273/167 |
| 5,190,289 | 3/1993 | Nagai et al. | 273/167 E |

FOREIGN PATENT DOCUMENTS

| | | | |
|---|---|---|---|
| 2581319 | 11/1986 | France | 273/80 B |
| 16471 | of 1910 | United Kingdom | 273/80 R |
| 373930 | 6/1932 | United Kingdom | 273/80 R |
| 462155 | 3/1937 | United Kingdom | 273/81.6 |

OTHER PUBLICATIONS

"Plastics World", Magazine, Sep. 1984 issue, pp. 39–41.

*Primary Examiner*—Jessica J. Harrison
*Assistant Examiner*—Sebastiano Passaniti
*Attorney, Agent, or Firm*—Hopkins & Thomas

[57] ABSTRACT

A novel golf club (10) and associated methodology optimally minimize air resistance during swinging motion of the golf club (10). The golf club (10) comprises a head (12) for striking a golf ball, a handle (18) for swinging the golf club (10) and a shaft (22) connecting the head (12) with the handle (18). A rib (24) protrudes outwardly from the shaft (22) and runs longitudinally along the shaft (22) in a spiral configuration. The spiral configuration has a pitch which decreases from the head (12) to the handle (18). The spiraling configuration of the rib (24) minimizes vortices and drag generated when the golf club (10) is in motion to thereby decrease air resistance to the golf club (10). Furthermore the golf club (10) is provided with a novel head (12) having a body with a face (14) angled inwardly, a rear end (38) angled inwardly, right and left sides decreasing in curvature from the rear end (38) to the face (14), a substantially flat bottom (46), and a top (48) which is circular as viewed from the face (14) and is parabolic as viewed from the right and left sides (42, 44).

27 Claims, 2 Drawing Sheets

GOLF CLUB AND METHOD

FIELD OF THE INVENTION

The present invention generally relates to the sport of golf and, more particularly, to a novel golf club and method for minimizing air resistance during golf club swinging motion.

BACKGROUND OF THE INVENTION

A golf club includes a head for striking a golf ball, a handle including a grip for swinging the golf club, and a shaft connecting the head to the handle. A golf club encounters air resistance when it is swung for hitting a ball. This air resistance results in a drop in head speed and in irregular vibration in the shaft of the golf club. The drop in head speed in turn reduces the flying distance of the ball, and the irregular vibration of the shaft affects the directionality of the ball.

Attempts have been made in the past to construct a golf club which minimizes air resistance. U.S. Pat. No. 4,648,598 to Kim describes a golf club with an air permeable shaft. The golf club comprises an air permeable skeletal-like shaft formed from a plurality of spaced rods which are concentrically arranged about a longitudinal axis. A spiral wrapping is disposed about the skeletal-like shaft of the golf club for providing structural reinforcement. The rods allegedly reduce wind drag or resistance during the golf swing. Although perhaps not devoid of all merit, the foregoing construction suffers from extreme complexity, questionable durability, expensive and burdensome construction, aesthetically displeasing appearance, and only nominal reduction in wind resistance during the golf club swing.

SUMMARY OF THE INVENTION

Accordingly, an object of the present invention is to overcome the deficiencies and problems associated with the prior art as recited above.

Another object of the present invention is to provide a golf club and method which optimally minimize wind resistance during golf club swinging motion.

Another object of the present invention is to provide a golf club and method which are simple and inexpensive to implement.

Another object of the present invention is to provide a golf club which is aesthetically pleasing.

Another object of the present invention is to provide a golf club which is simple in design, durable in structure, and reliable while in use.

Another object of the present invention is to provide a golf club which minimizes air resistance while conforming to the stringent requirements of the U.S. Professional Golf Association (USGA).

Briefly described, the present invention is an improvement for any golf club having a head for striking a golf ball and a shaft connected to the head at a first end and having a handle at a second end. The improvement substantially reduces air resistance to the golf club while the golf club is in swinging motion. The improvement comprises a rib protruding slightly outwardly from the generally tapering cylindrical surface of the shaft and running longitudinally along the shaft in a spiral configuration. Preferably, the rib is formed in a spiral configuration with a spiralling pitch which increases from the head to the handle of the golf club. The spiral configuration of the rib optimally minimizes air vortices and drag generated when the golf club is in motion to thereby decrease air resistance to the golf club.

In order to further minimize air resistance, the novel golf club may be provided with a novel head which minimizes air resistance. The novel head comprises a body having a face angling inwardly, a rear end angling inwardly, right and left sides decreasing in curvature from the rear end to the face, a substantially flat bottom, and a top which is circular as viewed from the face and which is parabolic as viewed from the sides. Moreover, in the head, the width of the face as measured from the front is shorter than the length of the head as measured from one of the sides. The shape of the head results in improved aerodynamics and yet still conforms to USGA requirements.

Another feature of the present invention is that the golf club shaft and/or golf club head may be provided with a rough or abrasive outer surface, for instance, by affixing, molding, or otherwise disposing a granular finish thereon, in order to minimize air resistance by decreasing separation drag.

Other objects, features, and advantages of the present invention will become apparent to one of skill in the art upon examination of the following drawings and detailed description.

DETAILED DESCRIPTION OF THE PREFERRED EMBODIMENT

Figure 1:
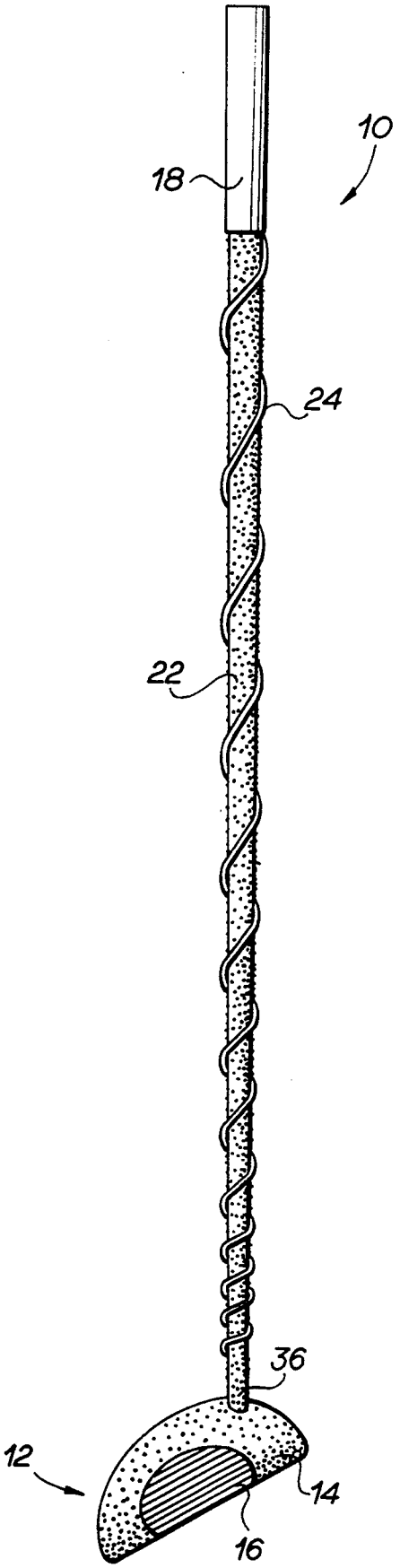
FIG. 1 is a front elevational view of the novel golf club and method in accordance with the present invention.

Referring now to the drawings wherein like reference numerals designate corresponding parts throughout the several views, a novel golf club 10 and associated novel methodology are illustrated in FIGS. 1 through 6. As shown in FIG. 1, the golf club 10 comprises a head 12 having a face 14 with a striking plate 16 for contacting a golf ball, a handle 18 for swinging the golf club 10, and a generally cylindrical shaft 22 for connecting the head 12 to the handle 18.

Figure 2:
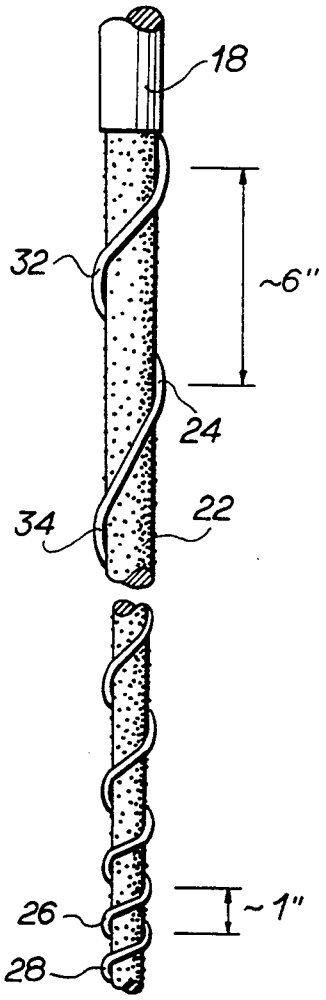
FIG. 2 is a partial exploded front elevational view of the golf club shaft of FIG. 1.

In accordance with a significant aspect of the present invention, the golf club 10 has a spiraling rib 24 protruding slightly outwardly from the generally tapering cylindrical outer surface of the shaft 22, running around the circumference of the shaft 22, and running longitudinally along the shaft 22 in a spiral configuration, as shown in FIGS. 1 and 2. The spiraling rib 24 optimally minimizes air vortices and drag generated behind the shaft 22 when the shaft 22 is in motion during a golf club swing. In essence, the minimization of vortices decreases the effective air resistance experienced by the golf club 10 while in motion.

The spiraling rib 24 may be formed by any conventional technique, for example, but not limited to, a molding process, lamination process, or some other suitable fabrication process. Another workable example of a process for fabricating the spiraling rib 24 is to dispose a cord, for instance, a metal wire, elongated plastic element, nylon fiber, or other elongated element made from some other suitable material, about the shaft 22 in a continuous spiral configuration. Further, the cord may be affixed to the shaft 22 via a bonding agent, such as glue, and/or may be wrapped tightly for binding securement.

Although not required, the spiral configuration of rib 24 should have a pitch which increases from the head 12 to the handle 18, as shown in FIGS. 1 and 2, in order to achieve optimal minimization of air vortices and drag. More specifically, it is preferred that the length cf one complete wrap of the rib 24 around the shaft 22 at a particular region be approximately equal to four times the average diameter of the shaft 22 at that particular region. In a specific workable embodiment of the present invention, the spiraling rib 22 protrudes from the shaft 22 approximately 1/16 of an inch, and the pitch of the spiraling rib 24 increases from approximately one inch from adjacent rib sections 26, 28 near the head 12, as indicated in FIG. 2, to approximately six inches between adjacent rib sections 32, 34 near the handle 18, as further indicated in FIG. 2.

The shaft 22 with rib 22 may be formed from any suitable construction material, including, for example, metal, graphite, plastic, wood, or any combination thereof with a finish of perhaps paint, plastic, synthetic or natural varnish, or any other suitable coating material. However, the shaft 22 should have a substantially cylindrical outer surface with the rib 22 protruding therefrom so that the rib 22 channels and directs air towards the head 12.

It should be further noted that the spiraling rib 24 need not extend completely from the head 12 to the handle 18, as illustrated in FIGS. 1 and 2. The spiraling rib 24 is shown in FIGS. 1 and 2 to span entirely from the head 12 to the handle 18 for aesthetic reasons. In fact, preferably for optimum aerodynamic effect, the spiraling rib 24 should extend from the head 12 upwardly along the shaft 22 to cover only approximately 75% of the shaft 22. Furthermore, as shown in FIG. 1, a foremost lower shaft portion 36 of the shaft 22 near the head 12 is free of the rib 24 so as to create a fixed vortex on the head 12. Optimally, the distance between the head 12 and the start of the rib 24 measures about two times the average diameter of the shaft 22 in the region 36. In essence, air is channeled toward the head 12 during the swinging of the golf club, which helps to eliminate drag behind the shaft 22.

In order to further enhance swinging motion by minimizing air resistance, the shaft 22 may be provided with a rough outer finish or texture. This may be accomplished by coating the shaft 22 with granulized particles, preferably similar to the size of sand granules, as illustrated in FIGS. 1 and 2. The particles may be affixed to or otherwise disposed on the shaft 22 via any conventional means, for example, by using a bonding agent such as glue. The rough outer finish may also be realized by molding or fabrication processes relative to the shaft 22. In essence, the rough outer texture of the shaft 22 creates a turbulent boundary layer and reduces air separation.

Furthermore, a coating, such as plastic or other suitable material, may be disposed over the spiraling rib 24 and the shaft 22 so as to form a unitary shaft element with the spiraling rib 24 as an integral part of the shaft 22. This feature provides for better durability and operation.

Figure 3:
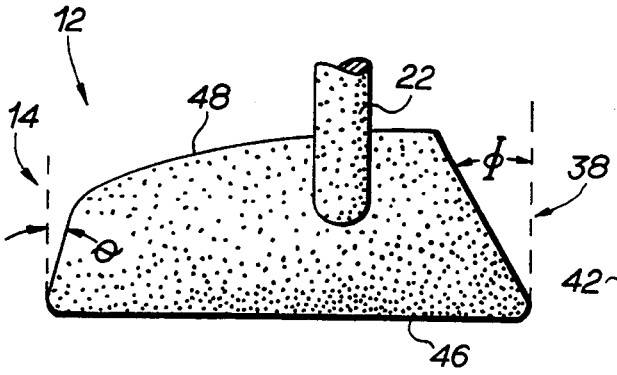
FIG. 3 is a right side elevational view of the golf club head of FIG. 1.
Figure 4:
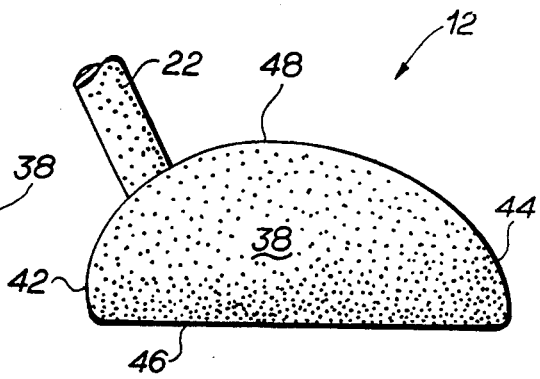
FIG. 4 is a rear elevational view of the golf club head of FIG. 1.
Figure 5:
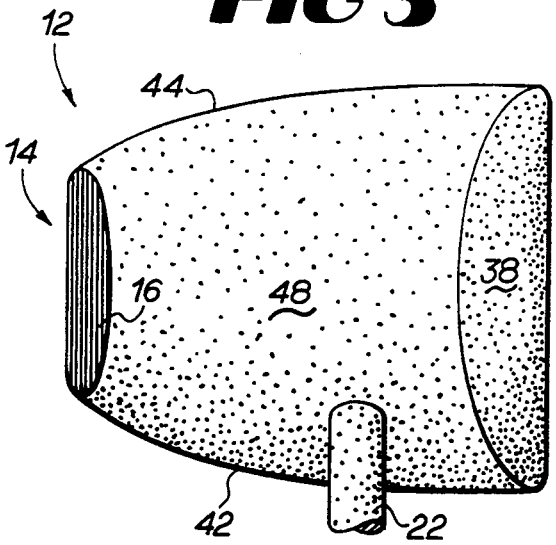
FIG. 5 is a top plan view of the golf club head of FIG. 1.
Figure 6:
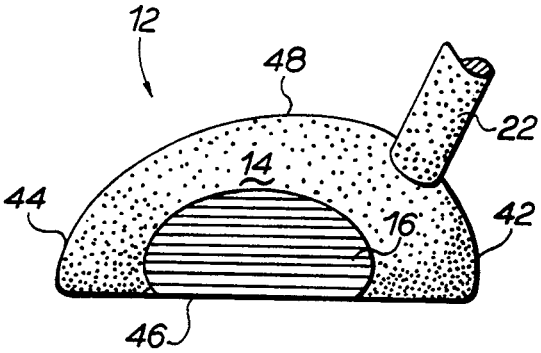
FIG. 6 is a front elevational view of the golf club head of FIG. 1.

The preferred construction for the head 12 of the golf club 10 is illustrated in FIGS. 3–6. As shown in FIG. 3, the head 12 has a body with a front face 14 angled inwardly by an angle theta $\theta$, preferably about 10°–20°. Further, a rear end 38 of the head 12 angles inwardly at an angle phi $\phi$, preferably about 40°. The rear end 38 has a circular top contour as shown in FIG. 4. As illustrated in FIG. 5, the right and left sides 42, 44, respectively, decrease parabolically in curvature from the rear end 38 to the front face 14. The bottom 46 of the head 12 is substantially flat, as illustrated in FIGS. 3, 4 and 6. Finally, a top 48 of the head 12 is circular as viewed from the front face 14 and is parabolic as viewed from the right hand left sides 42, 44. Because of the foregoing configuration, the air drag caused by the motion of the head 12 through the air is optimally minimized. The unique shape is such that the vortices which normally shed from the head are eliminated.

The head 12 may be formed from any suitable construction material, including, for example, metal, plastic, wood, or any combination thereof. Moreover, the finish of the head 12 may be paint, plastic, synthetic or natural varnish, or any other suitable coating material.

In addition, the head 12 may also be provided with a rough outer finish or texture, as shown in FIGS. 3 through 6. Preferably, the rough outer texture is effectuated by affixing or otherwise disposing granulized particles on the outer surface of the head 12. The granulized particles may be affixed to the head 12 via any conventional bonding agent, such as glue. The rough outer texture may also be realized by molding or fabrication processes relative to the head 12.

It will be obvious to those skilled in the art that many variations and modifications may be made to the above-described preferred embodiment without substantially departing from the spirit and scope of the present invention. Accordingly, all such variations and modifications are intended to be included herein within the scope of the present invention and the following claims.

Wherefore, the following is claimed:

1. A golf club improvement for a golf club having a head for striking a golf ball and a tapering cylindrical shaft connected to said heat at a first end and having a handle at a second end, said first end being narrower in width than said second end the improvement for substantially reducing air resistance to said golf club while in motion, comprising a rib protruding outwardly from said shaft and running longitudinally along said shaft in a spiral configuration, said spiral configuration having a pitch which increases in the direction from said head to said handle, said rib exhibiting sufficient spacing and protruding distance so that said rib is capable of reducing air drag behind said shaft while said club is in said motion.

2. The golf club improvement of claim 1, wherein said shaft is continuously tapering.

3. The golf club improvement of claim 2, further comprising a coating about said cord and said shaft to thereby form a unitary shaft element with said rib as an integral part of said shaft.

4. The golf club improvement of claim 1, wherein said spiral configuration is a substantially continuous element.

5. The golf club improvement of claim 1, wherein said rib protrudes form said shaft approximately one sixteenth (1/16) inches.

6. The golf club improvement of claim 1, further comprising particles affixed about the perimeter of said shaft.

7. The golf club improvement of claim 1, wherein said head comprises a body having a face angling inwardly, a rear end having a surface angling inwardly from an elongate rear bottom edge, said face having a front bottom edge which is substantially parallel to said rear bottom edge of said rear end, right and left sides decreasing in curvature from said rear end to said face, a substantially flat bottom, and a top which is semicircular as viewed from said face and is parabolic as viewed from said sides.

8. The golf club improvement of claim 7, wherein the width of said face as measured from the front is shorter than the length of said head as measured from a side.

9. The golf club improvement of claim 1, wherein said rib comprises a metal wire.

10. The golf club improvement of claim 1, wherein said rib comprises nylon.

11. The golf club improvement of claim 1, wherein said pitch increases from approximately one (1) inch between adjacent rib sections at said head to approximately six (6) inches between adjacent rib sections at said handle.

12. A golf club for minimizing wind drag, comprising:

a head for striking a golf ball;

a shaft connected to said head at a first end and having a handle at a second end, said shaft tapering from said second end to said first end so that said first end is narrower in width than said second end; and spiral means associated with said shaft, said spiral means for minimizing air vortices generated behind said shaft when said golf club is in motion to thereby decrease air resistance to said golf club, said spiral means comprising a rib protruding outwardly from the surface of said shaft and spirally running about said shaft with a pitch which increases in the direction from said first end to said second end.

13. The golf club of claim 12, wherein said shaft continuously tapers.

14. The golf club of claim 12, wherein said rib is a molded element.

15. The golf club of claim 12, wherein said rib is a laminated element.

16. The golf club of claim 12, wherein one complete wrap of said rib around said shaft at a particular region is approximately equal in distance to four times the average diameter of said shaft at said particular region.

17. The golf club of claim 12, wherein said rib is absent from a portion of said shaft adjacent said first end, whereby said portion in combination with said rib creates a fixed vortex on said head to thereby further decrease said air resistance of said golf club during said motion.

18. The golf club of claim 17, wherein said potion measures about two times an average diameter of said shaft in said portion.

19. The golf club of claim 12, wherein said spiral means is a substantially continuous element.

20. The golf club of claim 12, further comprising particles affixed about the perimeter of said shaft.

21. The golf club of claim 12, further comprising a coating about said rib and said shaft to thereby form a unitary shaft element.

22. A method for decreasing air resistance to the motion of a golf club, comprising the steps of:

forming a head for striking a golf ball;

forming a tapering cylindrical shaft connected to said head at a first end and having a handle at a second end, said first end being narrower in width than said second end;

forming a protrusion running outwardly from said shaft and longitudinally along said shaft in a spiral configuration for decreasing wind drag of said golf club; and forming said protrusion with a sufficient pitch increasing in the direction from said first end to said second end and with a sufficient outward extension from said shaft so that said protrusion is capable of reducing air drag behind said shaft when said shaft is moved through the air.

23. The method of claim 22, further comprising the steps of forming a body for said head by the following steps:

forming a face having a surface angling inwardly from an elongate front bottom edge;

forming a rear end having a surface angling inwardly from an elongate rear bottom edge;

situating said front and rear bottom edges to be substantially parallel;

forming right and left sides decreasing in curvature from said rear end to said face;

forming a substantially flat bottom; and forming a top which is semicircular as viewed from said face and parabolic as viewed from said sides.

24. A golf club head, comprising:

a front surface angling inwardly from an elongate front bottom edge, said front surface for contacting a golf ball;

a rear surface angling inwardly from an elongate rear bottom edge, said front bottom edge being substantially parallel to said rear bottom edge;

curved right and left sides each extending from said front surface and said sides angling outwardly from said front surface to said rear surface to said rear surface;

a substantially flat bottom; and a top which is semicircular as viewed in the direction normal to said front surface and which is parabolic as viewed in the direction normal to said sides;

said front surface being narrower in width than said rear surface from said left side to said right side.

25. The golf club head of claim 24, wherein the distance from said right side to said left side measured across said front surface is shorter than the distance from said front surface to said rear surface measured across either of said sides.

26. The golf club head of claim 24, wherein said front surface is angled inwardly between about 10° and 20° from a vertical plane comprising said front bottom edge.

27. The golf club head of claim 24, wherein said rear surface angles inwardly about 40° from a vertical plane comprising said rear bottom edge.

* * * * *